United States Patent [19]

Bartolotti et al.

[11] 4,395,155

[45] Jul. 26, 1983

[54] REFLECTIVE HIGHWAY MARKER

[76] Inventors: Frank Bartolotti, Camby Rd., Millbrook, N.Y. 12545; Douglas Dockstader, 48 High Meadows Pk., Dover Plains, N.Y. 12522

[21] Appl. No.: 178,990

[22] Filed: Aug. 18, 1980

[51] Int. Cl.[3] ..... E01F 9/04

[52] U.S. Cl. ..... 404/9; 350/103

[58] Field of Search ..... 404/16, 9, 11, 15; 116/63 R; 350/107, 103, 104, 105; 362/222, 341, 340; 340/117

[56] References Cited

U.S. PATENT DOCUMENTS

| | | | |
|---|---|---|---|
| 1,981,206 | 11/1934 | Strauss | 340/117 X |
| 2,329,171 | 9/1943 | Russ | 404/9 |
| 2,848,597 | 8/1958 | Knottnerus | 404/9 X |
| 3,332,327 | 7/1967 | Heenan | 350/103 X |
| 3,544,959 | 12/1967 | Hawks | 340/117 |
| 3,575,773 | 4/1971 | Courtot | 404/16 |
| 3,703,855 | 11/1972 | Converso | 404/11 |
| 3,836,226 | 9/1974 | Cechetini | 350/105 |
| 3,996,556 | 12/1976 | Eigenmann | 340/117 |
| 4,136,990 | 1/1979 | Morgan | 404/16 |
| 4,174,184 | 11/1979 | Heenan | 404/72 |
| 4,224,002 | 9/1980 | Heenan et al. | 404/16 X |

FOREIGN PATENT DOCUMENTS

| | | | |
|---|---|---|---|
| 1560288 | 2/1980 | United Kingdom | 404/16 |

OTHER PUBLICATIONS

Botts-Line Incorporated "Optical Laws and Botts-dots Traffic Markers" Sep. 1963-p. 3, FIG. 4 & FIG. 5.

*Primary Examiner*—Stephen J. Novosad
*Attorney, Agent, or Firm*—Stoll and Stoll

[57] ABSTRACT

A reflective highway marker mounted within an elongated groove formed in a highway pavement, the groove extending longitudinally of the highway and exposing the reflective highway marker to the headlights of oncoming motor vehicles when their approach distance from the reflective highway marker is adequate for highway guidance purposes. The reflective highway marker is provided with a reflective surface which is slightly inclined from the vertical and oriented to reflect back to the eye level of the average driver of an average vehicle a beam of light which emanates from the level of the average headlight on an average vehicle. The elongated groove is substantially narrower than the width of the narrowest motor vehicle tires conventionally in use to prevent destructive contact between the tires and the reflective highway marker.

5 Claims, 17 Drawing Figures

12
54
52
60
58
56
50
10
14
22
3
20
16
21
18
24

Fig. 6.
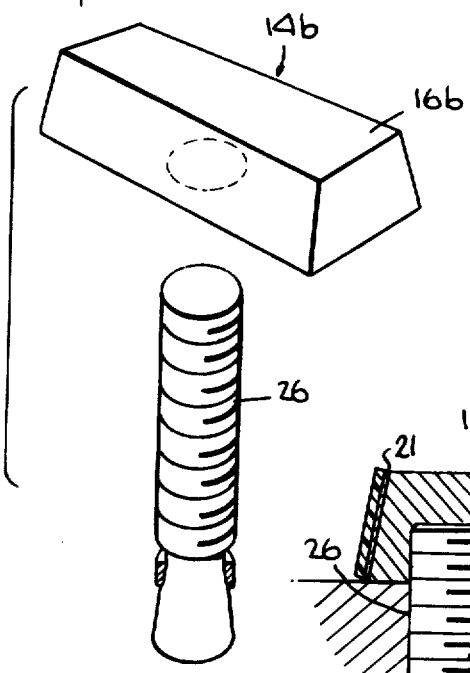
Fig. 10.
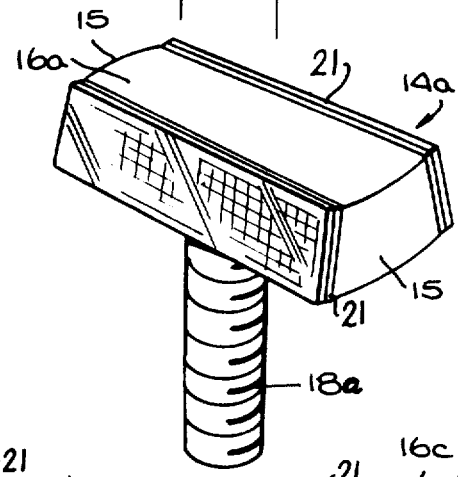
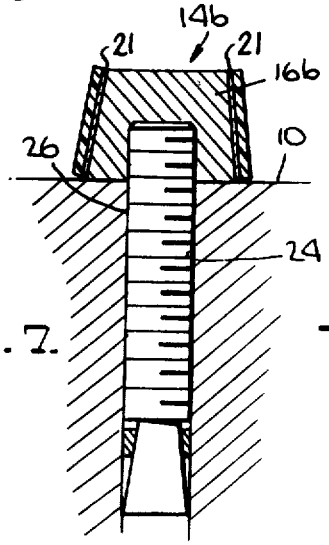
Fig. 7.
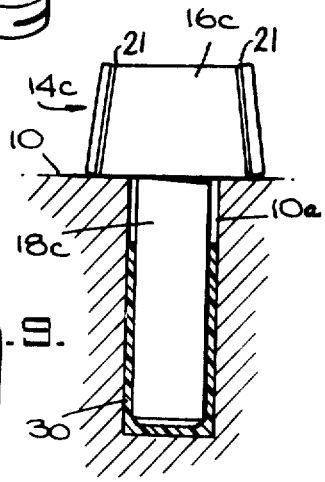
Fig. 9.
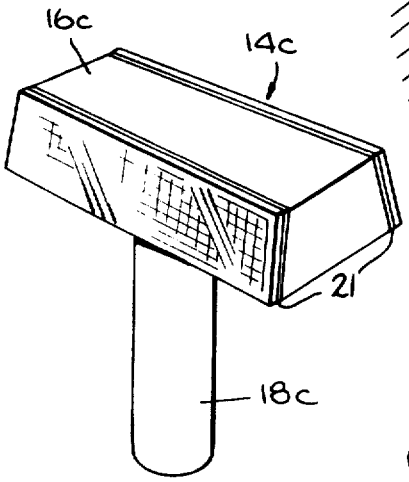
Fig. 8.
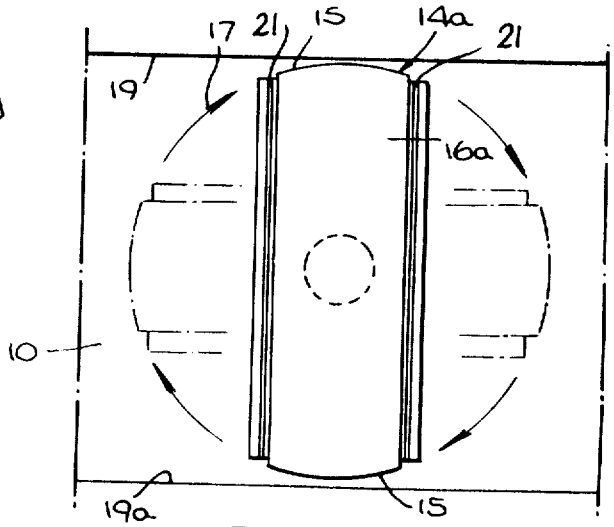
Fig. 11.

Fig. 16.
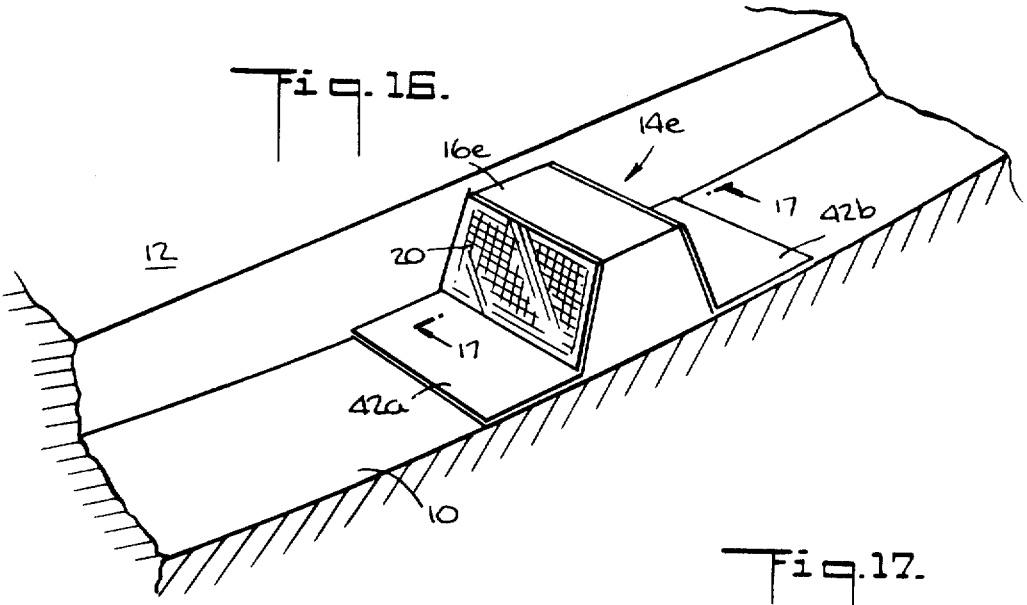
Fig. 17.
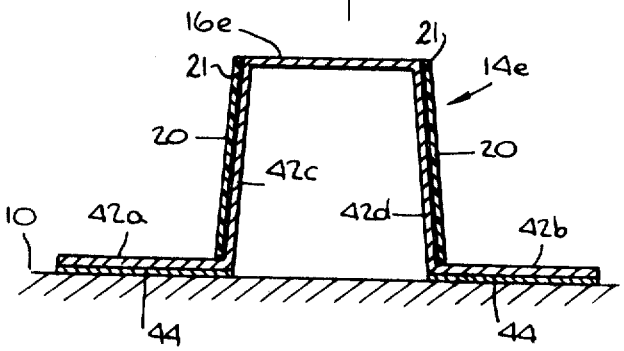
Fig. 15.
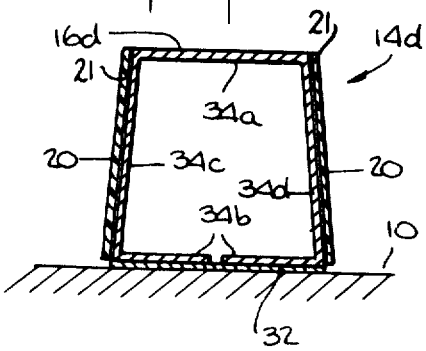
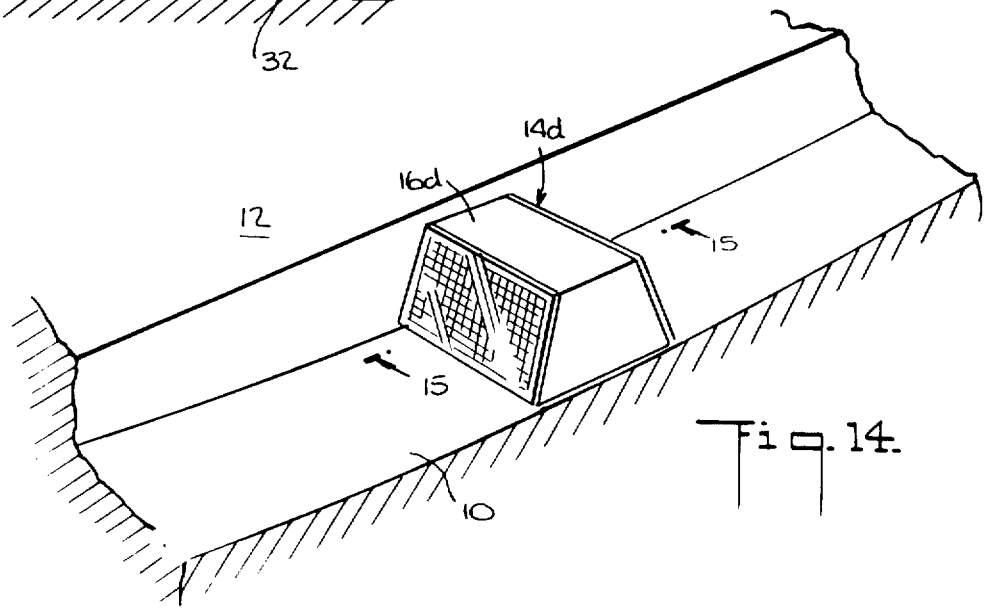
Fig. 14.

REFLECTIVE HIGHWAY MARKER

BACKGROUND OF THE DISCLOSURE

This invention relates to reflective highway markers used to mark highway lanes for guidance, cautionary and safety purposes. Conventional reflective highway markers may be classified in two general categories: (a) the group of reflective highway markers which are embedded within the highway pavement, and (b) the group of reflective highway markers which at least in part extend above the pavement surface. The latter group provides superior reflectivity under optimum conditions. However this group is vulnerable to snow plows and to the general destructive consequences of repeated contact with motor vehicle tires. The former category of reflective highway markers is protected against damage from snow plows and contact with motor vehicle tires but this category provides inadequate reflectivity at normally encountered approach distances.

An illustration of the category of embedded reflective highway markers is U.S. Pat. No. 4,136,990 issued to Alan W. Morgan on Jan. 30, 1979. While this patent discloses a highway marker which is mounted within a recess formed in a highway pavement, it is evident from the angle of the reflective surfaces, and from the clearance in advance of the reflective surfaces that the highway marker would not function when oncoming vehicles are at substantial approach distances, e.g., 200 yards from the highway marker. As stated in the specification of U.S. Pat. No. 4,136,990, column 2, lines 42–47 the reflective surfaces are positioned at an angle in the range of 30 to 60 degrees, presumably from the vertical. As stated in column 3 of the specification, lines 2–4, the individual marker is 4 inches square and it is mounted in a recess which is only ¾ of an inch deep (column 2, lines 61–64). It is evident that a marker made in accordance with this patent would be functionally effective within a relatively short range, and certainly nowhere near the 200 yard range above mentioned.

SUMMARY OF THE INVENTION

The principal object of this invention is to provide a reflective highway marker which is effective at substantial approach distances, e.g., 200 yards and even greater approach distances. The principal factor is the elongated groove in which the highway marker is mounted, and this, coupled with its relatively narrow angle of inclination exposes the reflective surface to the light beams of motor vehicle headlights while the motor vehicles are still substantial distances away. The 200 yard distance herein above mentioned is considered a safe distance under normal highway traffic conditions.

Another important objective of this invention is the provision of a reflective highway marker of the character described which is embedded in the highway pavement in such manner as to preclude destructive contact with both snow plows and motor vehicle tires. The mounting groove is narrower than the narrowest of conventional motor vehicle tires and this prevents the tires from entering the groove and making contact with the reflective highway marker. The length of the groove in advance of the reflective surface of the highway marker and the angle of inclination of said reflective surface determine the effective range of the highway marker.

Another purpose of the invention is to provide adequate securing means for a reflective highway marker of the character described. In one form of the invention the highway marker is pinned to the base of the groove. The pin may consist of a threaded stud and a suspension shield. Alternatively the pin may comprise an unthreaded stud adhesively secured in a bore hole formed in the base of the groove. There are other alternatives as for example a stamped and formed structure adhesively secured to the floor of the groove.

DESCRIPTION OF DRAWING

FIG. 6 is an exploded view in perspective showing the component parts of a modified form of highway reflector made in accordance with the present invention.

FIG. 7 is a fragmentary vertical section showing the modified form of highway reflector secured to a highway pavement by means of an expansion shield.

FIG. 8 is a perspective view of a third form of this invention.

FIG. 9 is a fragmentary vertical section showing the third form of highway reflector secured to a highway pavement by adhesive means.

FIG. 10 is a perspective view of a modified form of the highway reflector shown in FIG. 5, the ends of the modified highway reflector being arcuately configured to enable the reflector to be rotated within a highway pavement groove with relatively little clearance between the ends of the highway reflector and the walls of the groove.

FIG. 11 is a top view of the highway reflector illustrated in FIG. 10, showing the circle it describes when rotated within a highway pavement groove.

FIG. 14 is an enlarged fragmentary perspective view showing a modified form of highway reflector made in accordance with this invention and showing it adhesively secured to the floor of a groove formed in a highway pavement.

FIG. 15 is a sectional view through the highway reflector shown in FIG. 14 and taken on the line 15—15 of FIG. 14.

FIG. 16 is another fragmentary perspective view similar to that of FIG. 14, but showing a modification of the highway reflector of FIG. 14, also showing said modification adhesively secured to the floor of a groove formed in the pavement of a highway.

FIG. 17 is a section on the line 17—17 of FIG. 16.

DETAILED DESCRIPTION OF THE PREFERRED EMBODIMENTS OF THE INVENTION

Figures 1, 2, 3, 4, 5:
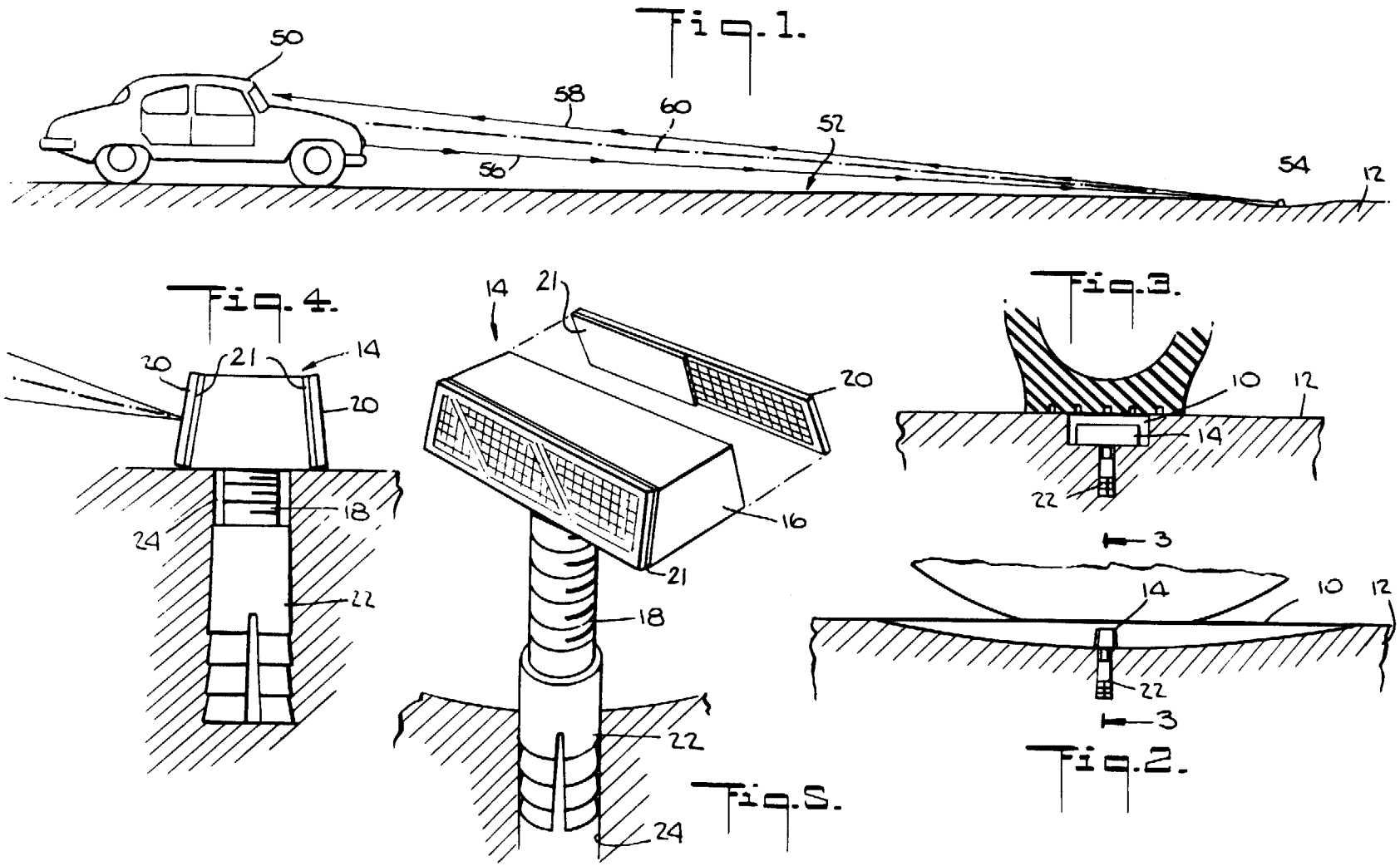
FIG. 1 is a vertical section, partly schematic, showing the light beams from an approaching motor vehicle impining upon the highway reflector of the present invention and being reflected back to the eye level of the driver of the vehicle.
FIG. 2 is an enlarged fragmentary vertical section showing the highway reflector mounted within a groove formed in a highway pavement.
FIG. 3 is a fragmentary vertical section taken on the line 3—3 of FIG. 2.
FIG. 4 is another enlarged fragmentary vertical section, partly schematic, showing a light beam from a motor vehicle impinging upon and being reflected back from a highway reflector made in accordance with the present invention and secured to the highway pavement by means of an expansion shield.
FIG. 5 is an enlarged, exploded, fragmentary view showing the component parts of the highway reflector.

Referring now to the details of the invention as illustrated in the drawing, it will be observed that an elongated groove 10 is formed in the pavement 12 of a highway and within the groove a reflective highway marker 14 is mounted. Regardless of the specific structure and method of affixation of the reflective highway marker, it is an important feature of this invention that the top of said marker be flush with the surface of the highway pavement, or, if not flush, then recessed slightly below the pavement surface. The precise height of the reflective highway marker is necessarily a compromise between two opposing factors: for exposure and reflective purposes the higher the reflective highway marker the better; for the purpose of protection of the reflective highway marker, the lower the marker the better. The optimum compromise in most highway situations is to mount the reflective highway marker with its top surface substantially flush with the surface of the pavement, but this compromise should be coupled with the requirement that the groove be narrower than the narrowest vehicle tires in conventional use. This would preclude destructive or injurious contact between the tire and the reflective highway marker. For purposes of illustration, an elongated groove 3 inches wide will provide the reflective highway marker with adequate protection.

The elongated groove should be formed with its longitudinal axis extending longitudinally of the highway in the area in which the groove is formed. In areas of highway curvature, the elongated groove should occupy the position of a tangent to the curve or such other position as highway engineers may require. The elongated groove also represents a compromise between opposing factors of requirements. The longer the groove in front of the reflective highway marker, the longer is the distance of exposure of the marker. On the other hand, the shorter the length of the groove in front of the reflective highway marker the more protection does the marker receive. In cases where the marker is provided with dual reflecting surfaces for opposing traffic, the marker should occupy a central position in the groove intermediate its respective ends. In such case an optimum length for the groove is 2 feet with approximately one foot (less one-half the thickness of the marker) of exposure both in front of and behind the marker. The groove may have an optimum range of 1 to 3 feet but it will be understood that the shorter the extent of the groove in front of the reflective surface of the marker the shorter will be the distance of visibility between the marker and the driver of an oncoming vehicle.

The shape of the groove is not critical provided that no obstruction to a light beam is placed between the reflective surface of the marker and the line of juncture between the groove and the highway pavement. The sides of the groove should define parallel planes perpendicular to the highway pavement. The floor of the groove should have an arcuate configuration in its preferred form. It provides optimum light beam clearance and it also facilitates formation of the groove in hard concrete or like pavement material. A groove of this configuration may be cut by a rotary saw or other suitable cutting or abrasive tool. The groove may also be formed in the concrete pavement at the time the pavement is laid and in such case an arcuate form, corresponding to the shape of the groove shown in the drawing, could be used to cast or mold the groove into the concrete. It should also be understood that the arcuate form depicted in the drawing is not critical and other forms, providing a substantially equal light beam clearance, would be equally useful for the purposes of the present invention. For example, a straight flat floor section extending from the base of the reflective highway marker to the highway pavement surface, preferably a foot forward of the marker, would be a suitable alternative for the arcuate configuration shown in the drawing.

Turning now to the details of the reflective highway marker itself, it will be noted that marker 14 comprises a body structure 16, a pin 18 projecting downwardly from the body structure and a reflective element 20 on at least one side of the body structure. For the purposes of this specification, the side on which reflective element 20 is mounted will be called the forward side or face of the marker. Since the same marker may also be used to guide opposing traffic in the opposite lane of the highway, a second reflective element 20 may also be mounted on the body structure of the marker and this would be done on what might be termed the reverse side or back of the marker. The reflective element 20 may be secured to the body structure by any conventional means, such as adhesive 21, and this is equally true of the other embodiments of the reflective highway marker shown in the drawing.

Pin 18 is one means of anchoring the marker in groove 10. This pin may be threaded as shown for example in FIG. 5 but it may also be unthreaded as shown for example in FIG. 8. When threaded, it may be provided with an expansion sleeve or shield 22 and inserted into a bore hole 24 formed in the floor of the groove. By rotating the body structure 16 the expansion sleeve or shield will be caused to expand and to anchor the marker in the groove. In this illustrated form of the invention we have a standard expansion bolt or anchor means for securing the marker in place. In all preferred forms of the invention it is desirable that the groove be no wider than the marker, with sufficient clearance for insertion of the marker into the groove. If the marker is to be rotated into an expansion shield as above described, slightly more clearance would be needed between the body structure of the marker and the parallel side walls of the groove. Alternatively, the sides of the body structure may be arcuately rounded to facilitate rotation of the marker in the groove without requiring additional clearance between them.

Illustrative of a reflective marker having arcuately rounded body structure is marker 14*a* shown in FIG. 10. This marker may have the same construction as marker 14 but the sides or ends 15 of body structure 16*a* are arcuately configured as shown in FIG. 10 and also in FIG. 11. It will be understood that threaded pin 18*a* or marker 14*a* engages an expansion sleeve or shield 22 precisely as shown in FIG. 4 and marker 14*a* is thereby secured within a groove 10 formed in pavement 12. The sides of the groove shown in FIG. 11 are indicated by means of reference numerals 19 and 19*a* and it will be observed that there is a relatively small clearance between the arcuate ends of body structure 16*a* and the side walls 19 and 19*a* of the groove. Arrows 17 indicate that marker 14*a* may be rotated within the groove although the clearance between ends 15 and walls 19 and 19*a* is relatively small.

Another alternative form of reflective highway marker is marker 14*b* which comprises a body structure 16*b* and a conventional expansion stud 26. Stud 26 (which would perform the function of a pin) is anchored in conventional manner in a bore hole formed in the floor of the groove. The upper end of the expansion stud is threaded and the body structure 16*b* is provided with a threaded hole to receive said threaded end of the expansion stud. Securing the reflective highway marker 14*b* in groove 10 involves a two-phase operation wherein the expansion stud is initially anchored in the bore hole formed in the floor of the groove and the body structure 16*b* is then threaded to the exposed threaded upper end of the expansion stud.

Still another alternative form of reflective highway marker made in accordance with the present invention is marker 14*c* shown in FIGS. 8 and 9. This marker is provided with a body structure 16*c* and a pin 18*c* which is non-threaded. This pin may be inserted into a bore hole 10*a* formed in the pavement of a highway and it may be secured therein by means of an epoxy resin adhesive 30. See FIG. 9.

Another alternative form of reflective highway marker is marker 14*d* which comprises no more than a body structure 16*d* and a pair of reflective elements 20 mounted thereon. The body structure is secured to the floor of the highway groove by means of an adhesive layer 32, such as a layer of epoxy resin adhesive. In this form of the invention the reflective highway marker is not pinned to the concrete. See FIGS. 14 and 15.

In all of the preceding forms of the reflective highway marker herein claimed the body structure may take the form of a metal casting, preferably solid. However, the last described form (FIGS. 14 and 15) may have a stamped and formed body structure as shown in the drawing. This body structure comprises a four-sided shape with top, bottom, front and back walls 34*a*, 34*b*, 34*c* and 34*d* respectively, wherein the top and bottom walls 34*a*, 34*b* are generally parallel (and horizontal when the unit is installed) and the front and back walls 34*c*, 34*d* are inclined toward each other in upward direction, as described above. Body structure 16*d* may be stamped of strip steel and bent along four parallel lines to the shape illustrated.

A modification of this form of the invention is shown in FIGS. 16 and 17 where reflective highway marker 14*e* comprises a stamped and formed body structure 16*e* having a pair of reflective elements 20 mounted thereon. Specifically, body structure 16*e* comprises a steel stamping in the configuration of an inverted "U" having a pair of horizontally aligned extension pieces 42*a* and 42*b* formed integrally with legs 42*c* and 42*d* of the inverted U-shaped structure. Reflective elements 20 are mounted on legs 42*c* and 42*d*. Reflective highway marker 14*e* may be secured to the floor of the groove by the use of adhesive layers 44 on extension pieces 42*a*, 42*b*. As before, the adhesive is preferably an epoxy resin type although any other adhesive, suited for the purpose, may be used.

The configuration of the body structure 16*e* corresponds, substantially, to the configuration of body structure 16*d*, except for extension pieces 42*a*, 42*b*. Legs 42*c*, 42*d* correspond to front and back walls 34*c*, 34*d* and are inclined toward each other in upward direction.

Among the advantages of the stamped and formed reflective highway marker 14*e* is the enlarged and extended base which extension pieces 42*a*, 42*b* provide. This makes for greater stability and a stronger bond than is possible with a body structure such as is provided in reflective highway marker 14*d*. An advantage in the stamped and formed body structure over the cast structure may be found in reduced cost of production. On the other hand, a solid cast body structure may be found to be more durable and resistant to the adverse conditions which are encountered on public highways.

It has above been indicated that the sides of the body structure on which the reflective elements are mounted are inclined from vertical. This of course is evident from the drawing but special attention should be paid to FIGS. 1 and 4 wherein the purpose and extent of the angle of inclination are shown. Specifically, an average motor vehicle 50 is depicted traveling along a highway 52 and approaching reflective highway marker 54 made in accordance with one of the forms of the invention above described. What is meant by "average motor vehicle" is what may be considered statistically to have headlights situated at an average or mean level above the highway surface, and with its driver seated with his eye level an average or mean distance above the highway surface. It is of course recognized that the disparity between the headlight and eye levels in a subcompact automobile and an over-the-road truck is very substantial but we are here concerned with an average or mean location for each of these two levels for the purpose of determining an optimum angle of inclination for the reflective surface of the highway marker. As indicated in FIG. 1 the light beam 56 (incident beam) from the headlights of motor vehicle 50 impinges on the reflective surface of highway marker 54 and is reflected back in the form of reflected beam 58 to the eyes of the driver. A line 60 drawn midway between incident and reflected beams 56,58 will be normal to the reflective plane of the highway marker and this will determine the angle of inclination of said reflective plane. More precisely, the angle of inclination between the reflective plane and the vertical will range between 1 and 5 degrees, the optimum being 2 degrees.

Here, too, a compromise is needed. What is "optimum" in the angle of inclination of the reflective surface of the highway marker is determined largely by the operative distance which is sought for the highway marker. Assuming for purposes of illustration that highway engineers would specify an operative distance of 200 yards, it would be necesaary to place the average vehicle at an approximate distance of 200 yards from the marker and then project a median line 60 between the incident headlight beam 56 and the reflected beam 58 at the point of impingement upon the reflective surface of the marker. Median line 60 will be normal to the reflective surface. The angle of inclination between said reflective surface and the vertical would then be measured and that would be the optimum angle of inclination under the specifications of the highway engineers.

A range of angles of inclination is herein provided for the reason that highway engineering requirements for different highway conditions may vary. What is also to be taken into account is the fact that the reflective elements in common highway use are adapted to reflect light beams impinging upon them within a relatively wide angular range. Reference is here made, for example, to the reflective element which is manufactured and sold by Amerace Corporation under the trademark STIMSONITE. This type of reflective element involves a prismatic or cube-corner method of retro-reflectance.

Some of the advantages of the present invention will now be apparent. For example, in the event it is desired to place the reflective surface of the highway marker at an angle to the longitudinal axis of the highway, as for example at a curve, all that need be done is to rotate the marker to the desired angular position and then to affix it in that position. If the marker is held in place adhesively it would be placed in the desired angular position before the adhesive is set. If the highway marker embodies a threaded pin it would simply be rotated to, and tightened in, the selected angular position. If this reflective angle is desired for the face and reverse side of the marker the body structure could be cast or stamped and formed with its face and reverse side at the required angles.

Figure 12:
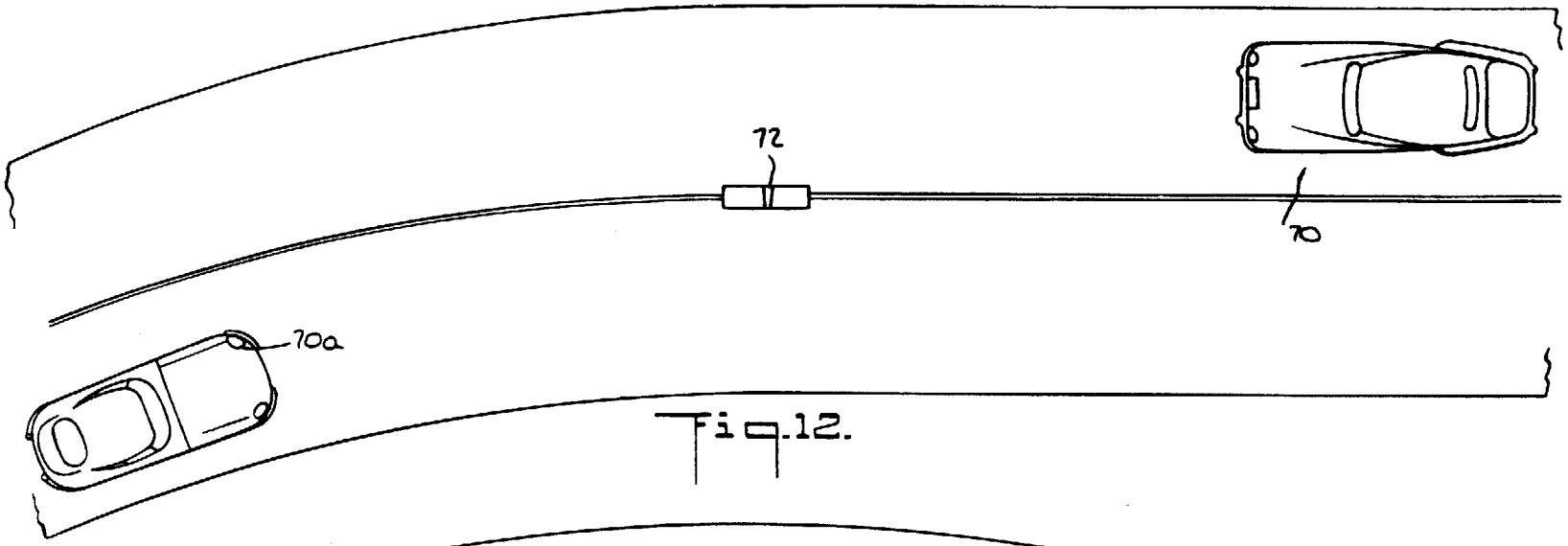
FIG. 12 is a schematic view showing straight and curved highway sections and approaching motor vehicles in opposing lanes of traffic with a single highway reflector as herein claimed configured to be operative with respect to both opposing lanes of traffic.
Figure 13:
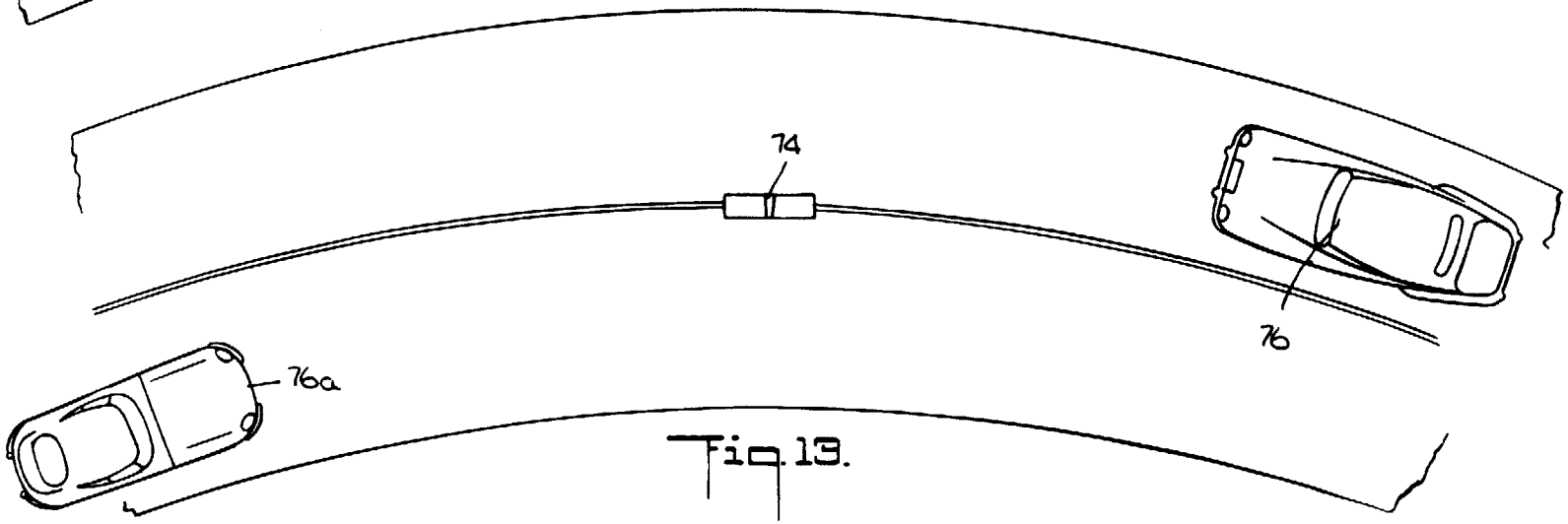
FIG. 13 is a schematic view showing a curved stretch of highway and a highway reflector configured to be effective with respect to vehicles in the opposing lanes of traffic.

Referring now to FIGS. 12 and 13, schematic showings are made of different highway curve situations wherein different reflective marker configurations may be desired. For example, in FIG. 12 vehicle 70 is moving along a straight approach to a curve, while vehicle 70*a*, in the opposing lane of traffic, is in the curve. Reflective marker 72 made in accordance with any of the forms of this invention, may have its reflective surface facing vehicle 70 perpendicular to the straight dividing line between the opposing straight lanes of traffic, while the reflective surface facing vehicle 70*a* may be angled toward said vehicle, such that the light beams from said vehicle will strike said reflective surface at an angle fairly close to 90 degrees.

In FIG. 13 reflective marker 74 is located on a curved stretch of highway facing opposing vehicles 76 and 76*a* which are both engaged in negotiating the curve. To meet this condition, it may be desirable that both reflective surfaces of marker 74 be angled to provide a normal reflective surface for the light beams of the respective vehicles. In this connection it should be understood that the light beams are diffused so that even in the case of vehicles in the outer lanes of curved stretches of highways some light rays will impinge on the reflective surface of the highway marker in perpendicular relation thereto.

In the use of reflective highway markers made in accordance with this invention, the recessed position of the marker with respect to the highway surface is coupled with the relatively narrow cross-dimension of the groove protecting the marker from destructive or injurious contact with the tires of the motor vehicles which use the highway. Contact with snow plows or other cleaning equipment is also prevented. Under rain conditions the markers are kept relatively free of rain water by reason of the suction which is caused by the tires of the motor vehicles. It has been found that this suction effectively empties the grooves of rain water or any foreign matter that might otherwise tend to accumulate therein.

The foregoing is illustrative of the preferred forms of this invention and it will be understood that other forms and modifications of these forms may be used depending on the requirements of highway engineers and the conditions of the highways, all within the scope and coverage of the appended claims.

We claim:

1. A method of providing a reflective marker in a highway, comprising the steps of:

(a) forming in a highway pavement an elongated groove oriented with its longitudinal axis entending substantially longitudinally of the highway, and (b) affixing the said groove a reflective highway marker whose height does not exceed the depth of the groove at the place of affixation, (c) said reflective highway marker having a reflective surface which is oriented to face oncoming vehicles, (d) the length and depth of the groove forward of said reflective highway marker being sufficient to expose said reflective surface to drivers of oncoming vehicles when their approach distance from the reflective highway marker is adequate for highway guidance purposes, (e) the groove which is formed in the highway pavement being narrower that the width of vehicle tires to prevent destructive contact between the vehicle tires and the reflective highway marker, (f) said elongated groove being tapered in depth forward of the reflective highway marker from substantially zero depth where the groove terminates at the pavement of the highway to a depth substantially corresponding to the height of the reflective highway marker at the place of affixation thereof, (g) the length of the elongated groove formed in the highway pavement ranging from approximately 1 foot to approximately 3 feet, (h) the length of the elongated groove forward of the reflective surface ranging from approximately 1 foot to approximately 1 foot, 6 inches, (i) the depth of the elongated groove at the place of affixation of the reflective highway marker approximating 1 inch, (j) the width of the elongated groove ranging from approximately 1.5" to approximately 3.5", and (k) the reflective surface on the reflective highway marker is inclined rearwardly from its lower to its upper edge at an angle ranging from approximately 1 degree to approximately 5 degrees from the vertical.

2. A method in accordance with claim 1, wherein: the elongated groove has substantially the same tapered configuration behind the reflective highway marker that it has forward thereof.

3. A method in accordance with claim 1, wherein: the reflective highway marker is affixed in the highway pavement groove by being adhesively secured therein.

4. A method in accordance with claim 1, wherein: the reflective highway marker is affixed in the highway pavement groove by being pinned therein.

5. In combination with an elongated groove formed in a highway pavement with its longitudinal axis extending longitudinally of the highway, a reflective highway marker adapted to be affixed within the groove, said elongated groove being tapered in depth forward of the reflective highway marker from substantially zero depth where the groove terminates at the pavement of the highway to a depth substantially corresponding to the height of the reflective highway marker at the place of affixation thereof, and said groove being narrower that the width of vehicle tires to prevent destructive contact between the vehicle tires and the highway marker, said reflective highway marker comprising:

(a) a body structure being of a width to fit within said groove, (b) a reflective surface on at least one side of said body structure, and (c) means for affixing the body structure in said groove, (d) the height of said body structure not exceeding the depth of the groove in the area of affixation to preclude projection of the body structure above the surface of the highway pavement, (e) said body structure being positioned a sufficient distance behind the forward end of the groove to provide clearance for a light beam from a headlight of an oncoming vehicle to impinge upon the reflective surface and said reflective surface being angled to reflect said light beam back to the eye level of the driver of the oncoming vehicle when the approach distance of the vehicle from the reflective highway marker is sufficient for highway guidance purposes, (f) the length of the elongated groove forward of the reflective surface ranging from approximately 1 foot to approximately 1 foot, 6 inches, (g) the height of the body structure being approximately 1 inch, (h) the depth of the groove in the area of affixation not exceeding 1 inch, and (i) the reflective surface on the body structure being inclined rearwardly from its lower to its upper edge at an angle ranging from approximately 1 degree to approximately 5 degrees to the vertical.

* * * * *